US005324171A

United States Patent [19]

Cook

[11] Patent Number: 5,324,171

[45] Date of Patent: Jun. 28, 1994

[54] PUMP ASSEMBLY INCLUDING A HERMETICALLY SEALED SWITCH CAPSULE FOR HOUSING A MAGNETICALLY ACTUATED SWITCH

[75] Inventor: Charles E. Cook, Byron, N.Y.

[73] Assignee: Liberty Pumps, Bergen, N.Y.

[21] Appl. No.: 62,798

[22] Filed: May 14, 1993

[51] Int. Cl.[5] ..... F04B 49/04

[52] U.S. Cl. ..... 417/40; 200/84 C

[58] Field of Search ..... 417/40; 200/84 C

[56] References Cited

U.S. PATENT DOCUMENTS 2,730,591 1/1956 Nielsen .
3,450,051 6/1969 Anthon .
3,897,172 7/1973 Hall ..... 417/40
4,060,182 11/1977 Kikuchi .
4,129,140 12/1978 Carlin .
4,339,231 7/1982 Conery et al. ..... 417/40
5,100,343 3/1992 Peterson ..... 417/40 X
5,155,311 10/1992 Utke .
5,181,832 1/1993 Reents .

*Primary Examiner*—Richard E. Gluck
*Attorney, Agent, or Firm*—Cumpston & Shaw

[57] ABSTRACT

A pump assembly having a hermetically sealed switch cavity for retaining a magnetically actuated mechanical switch. The assembly includes a housing having a motor cavity and an integral guide for cooperating with an external float assembly. A housing cover includes electrically conductive pins extending therethrough and is connected to the housing to substantially seal the motor cavity. A switch cover cooperatively engages a portion of the housing cover to form the hermetically sealed switch cavity. The switch cavity also encloses at least one conductive pin in the housing cover.

12 Claims, 4 Drawing Sheets

FIG. 2
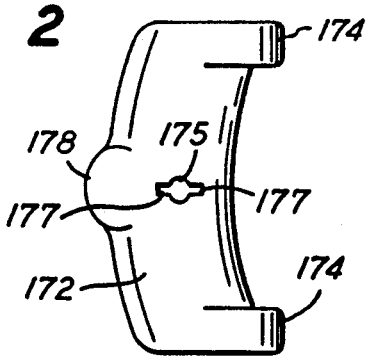
FIG. 7
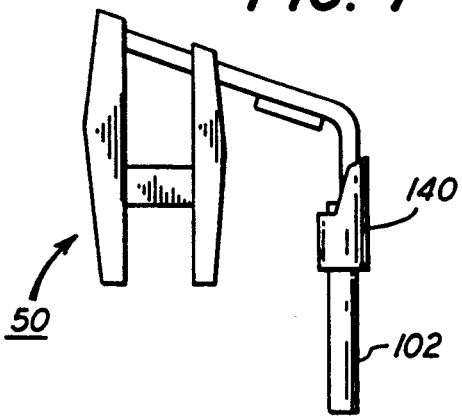
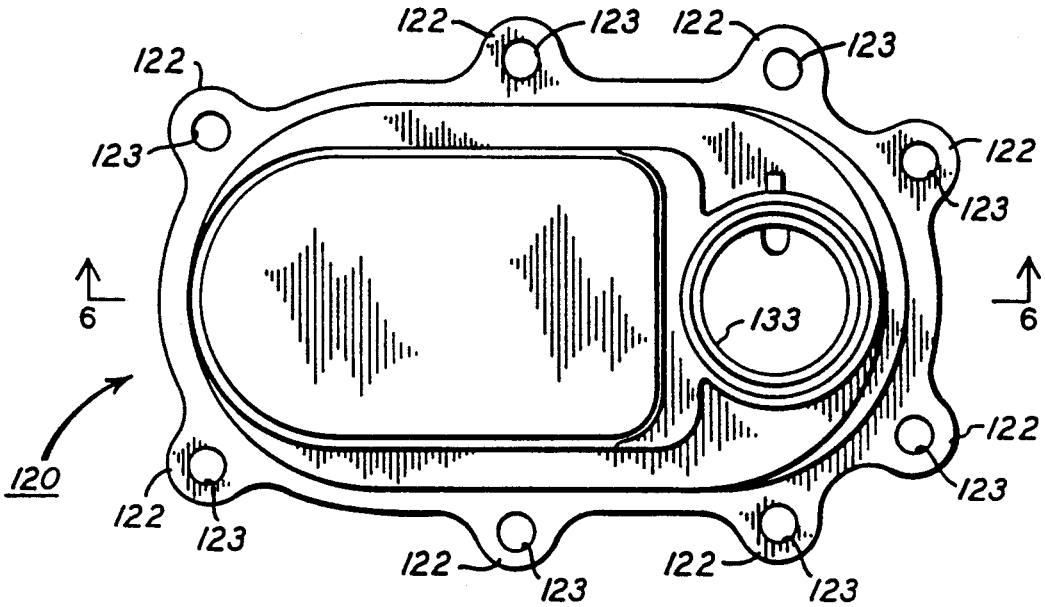
FIG. 5
FIG. 6
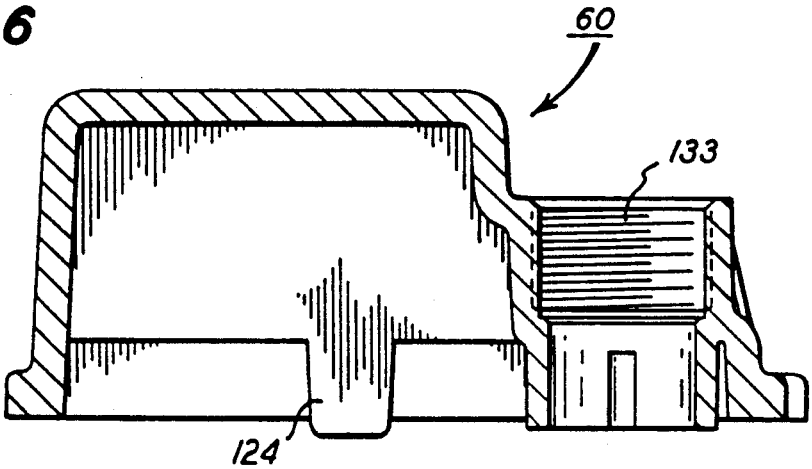

PUMP ASSEMBLY INCLUDING A HERMETICALLY SEALED SWITCH CAPSULE FOR HOUSING A MAGNETICALLY ACTUATED SWITCH

The present invention relates to fluid pumps and, more particularly, to a pump assembly having a housing and a hermetically sealed switch cavity, wherein the switch cavity retains a modular magnetically actuated mechanical switch which cooperates with a float actuated external magnet.

Fluid pumps such as sump pumps are often employed in environments which are unsuitable for many components of the pump. Specifically, the foreign matter in waste or discharge fluids may foul or clog moving mechanical parts. In fact, the critical components of the pumps, switch mechanisms and motors are particularly sensitive to foreign matter. Once the mechanical parts become clogged, the pump must be retrieved and serviced. This down time of the pump and extra labor increases the effective cost of the pump.

Prior pumps have sealed the pump motor in a housing so that only the drive shaft crosses the housing. However, the control mechanism for actuating the motor must also cross the housing. This mechanical linkage between the control and the motor is susceptible to foreign matter damage. Alternatively, the control mechanism may be located within the housing. However, the mechanical connection between the control mechanism and the float mechanism requires another mechanical linkage extending across the housing, which requires a seal about another moving part. Although seals provide initial protection of the switch and motor, any degradation of any seal may result in failure of the pump.

Therefore, a need exists for a pump assembly having reduced sealing requirements. The need exists for a pump assembly having a hermetically sealed switch cavity which physically isolates the switch mechanism from the operating environment. A further need exists for a pump assembly which facilitates assembly of the pump components without requiring extensive assembly procedures. The need also exists for a pump housing which locates and operably retains a float mechanism relative to the switch mechanism. A further need exists for an integral pump housing sized to enclose a motor and the switch mechanism, wherein the housing is compatible with the sealed switch cavity.

SUMMARY OF THE INVENTION

The pump assembly of the present invention includes a motor housing and a hermetically sealed switch cavity. The switch cavity is sized to retain a modular mechanical float actuated switch. In addition, the present invention employs a configured float structure for retaining a vertically displaceable magnetic element in a preferred orientation. The pump assembly includes embedded conductive connectors which reduce exposure of the connectors to the operating environment. In addition, the embedded conductive connectors replace the jumper/terminal assemblies previously used to interconnect the motor, power supply and switch mechanism. The embedded connectors also reduce the number of assembly steps, and thereby reduce installation errors. In a preferred embodiment, the pump assembly includes a housing having a motor cavity sized to retain a motor. A housing cover is connected to the housing to enclose the motor. The housing cover includes a plurality of conductive pins extending through the cover to the motor cavity. A switch cover is attached to the housing cover to enclose at least one pin, and form the switch cavity for retaining a modular mechanical switch.

BRIEF DESCRIPTION OF THE DRAWINGS

FIG. 2 is a top plan view of a float taken along lines 2—2 of FIG. 1;

FIG. 5 is a top plan view of the switch cover;

FIG. 6 is a cross sectional view of the switch cover taken along lines 6—6 of FIG. 5; and FIG. 7 is a side elevational view of a barrel connector.

DETAILED DESCRIPTION OF THE PREFERRED EMBODIMENT

Figure 1:
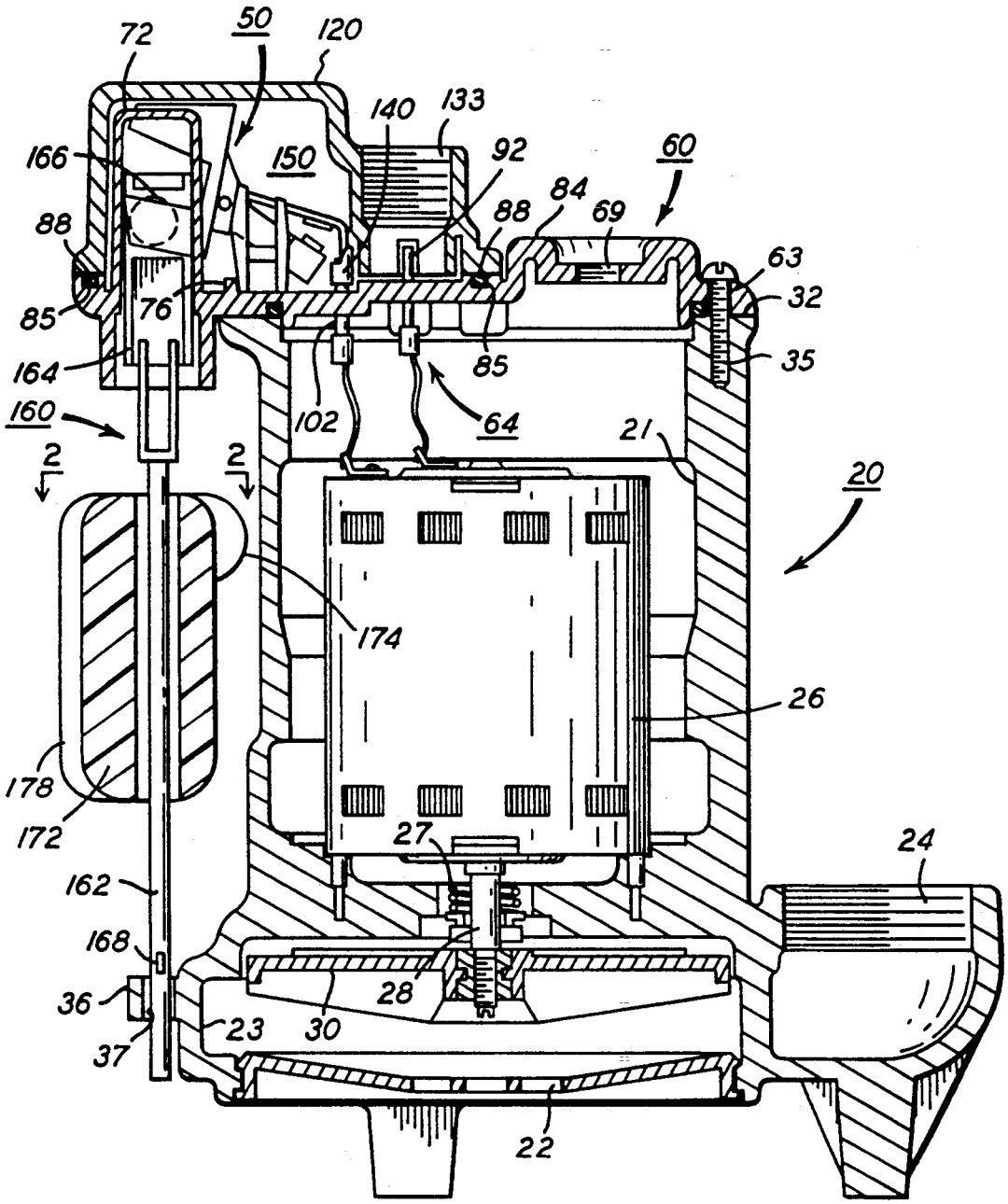
FIG. 1 is a cross sectional elevational view of the pump assembly.

Referring to FIG. 1, the present invention includes a housing 20, a housing cover 60, a switch cover 120 and a float assembly 160. The switch cover 120 and the housing cover 60 from a hermetically sealed switch cavity 150 for retaining a modular magnetically actuated mechanical switch 50.

As shown in FIG. 1, the housing 20 is preferably an integral one piece unit having a motor cavity 21, an impeller cavity 23, an inlet 22 and an outlet 24. However, the housing 20 may be formed of several component parts such as a volute, or base, a cylindrical section and a cover. The alternative configurations are known in the art and each configuration provides a motor cavity and a partition which cooperates with the switch cover.

In the integral housing embodiment, the motor cavity 21 is sized to receive a pump motor 26. The motor cavity 21 includes an open end and a substantially closed end, wherein the closed end includes a connecting aperture 27 for permitting passage of a motor drive shaft 28. Alternatively, the housing 20 may include an inverted cup shaped member, wherein the open end of the cup is exposed to the base and the closed end of the cup is distal to the base or volute.

The standard motor 26 is disposed within the motor cavity 21 and operably aligned with the housing 20. The motor drive shaft 28 extends through the connecting aperture 27 and is sealed as well known in the art. The impeller cavity 23 is formed below the motor cavity 21 and receives a portion of the drive shaft 28. An impeller 30 is operably retained on the drive shaft 28 in the impeller cavity 23. The impeller 30 draws fluid in through the inlet 22 and discharges the fluid through the outlet 24.

Referring to FIG. 1, the periphery of the open end of the housing 20 defines a planar cover sealing surface 32 which includes a plurality of threaded recesses 35. In alternative embodiments, such as the housing having the inverted cup, the cover sealing surface is not necessary. In the inverted cup configuration, a seal must be formed between the open end of the cup and the base.

In the alternative configurations, as in the preferred configuration, the housing 20 encloses the motor 26 and substantially seals the motor from the operating environment.

The housing 20 also includes an external guide 36 for cooperating with the float assembly 160. The external guide 36 is integrally formed with the housing 20 and defines an aperture 37 sized to cooperate with the float assembly 160. The guide may be integrally formed in the base, volute or housing. Although the guide 36 may be a separate component, the guide is preferably integral with the housing 20 to reduce assembly procedures. The external guide is spaced from the outlet 24, to permit access to the outlet without interfering with the float assembly 160.

The housing 20 may be formed by any process well known in the industry such as casting or molding. The housing 20 is formed of alloys such as cast iron, brass, aluminum, steel, stainless steel, or even plastics.

Figure 3:
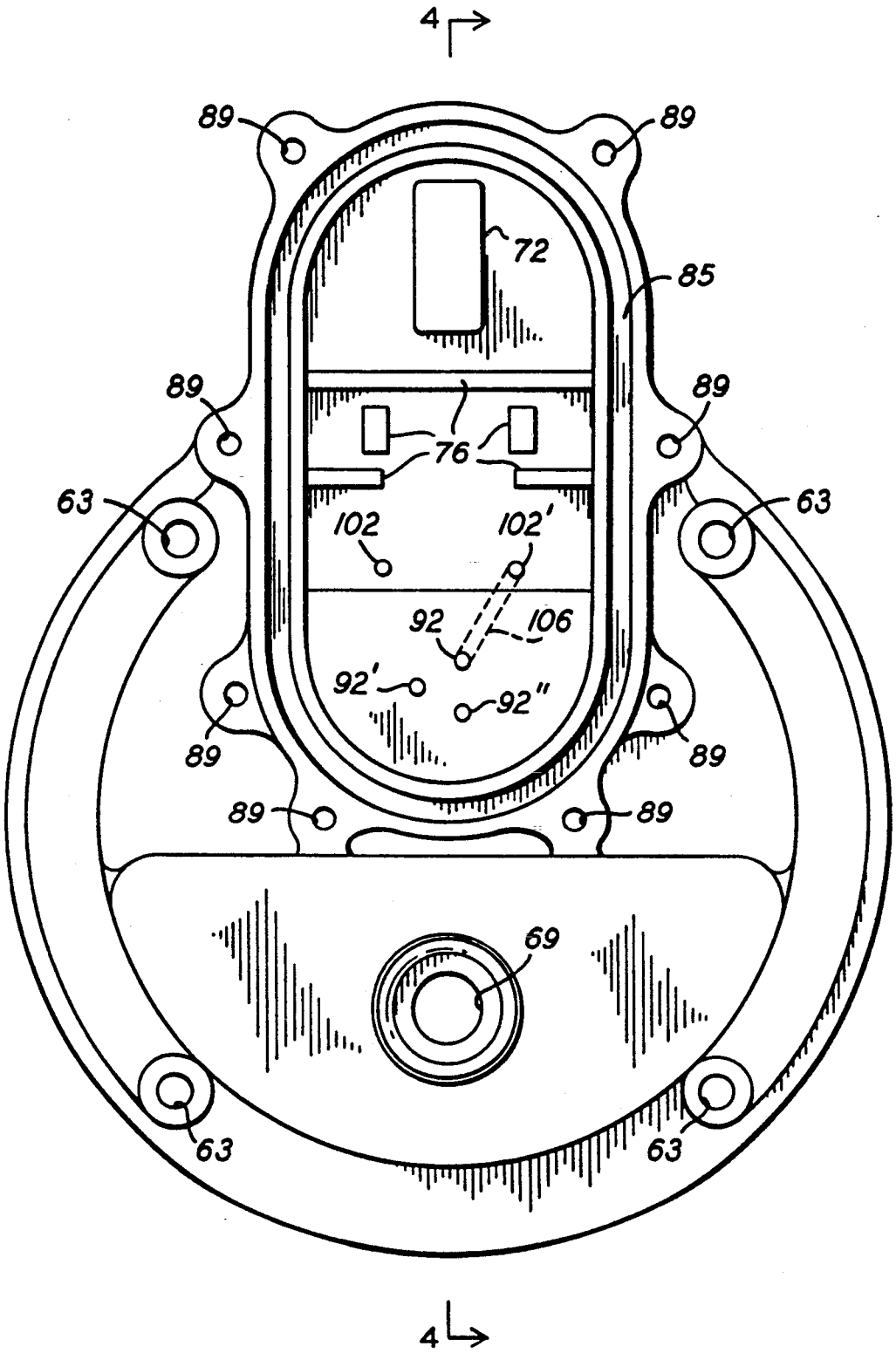
FIG. 3 is a top plan view of the housing cover of the pump assembly.

Referring to FIG. 1, the housing cover 60 is sized to cooperatively engage the open end of the motor cavity 21 along the sealing surface 32. As shown in FIG. 3, the housing cover 60 includes a plurality of peripheral apertures 63 which align with the threaded recesses 35 in the housing 20 upon operable engagement of the housing and the housing cover. The apertures 63 and recesses 35 are sized to receive fasteners such as screw or bolts.

Figure 4:
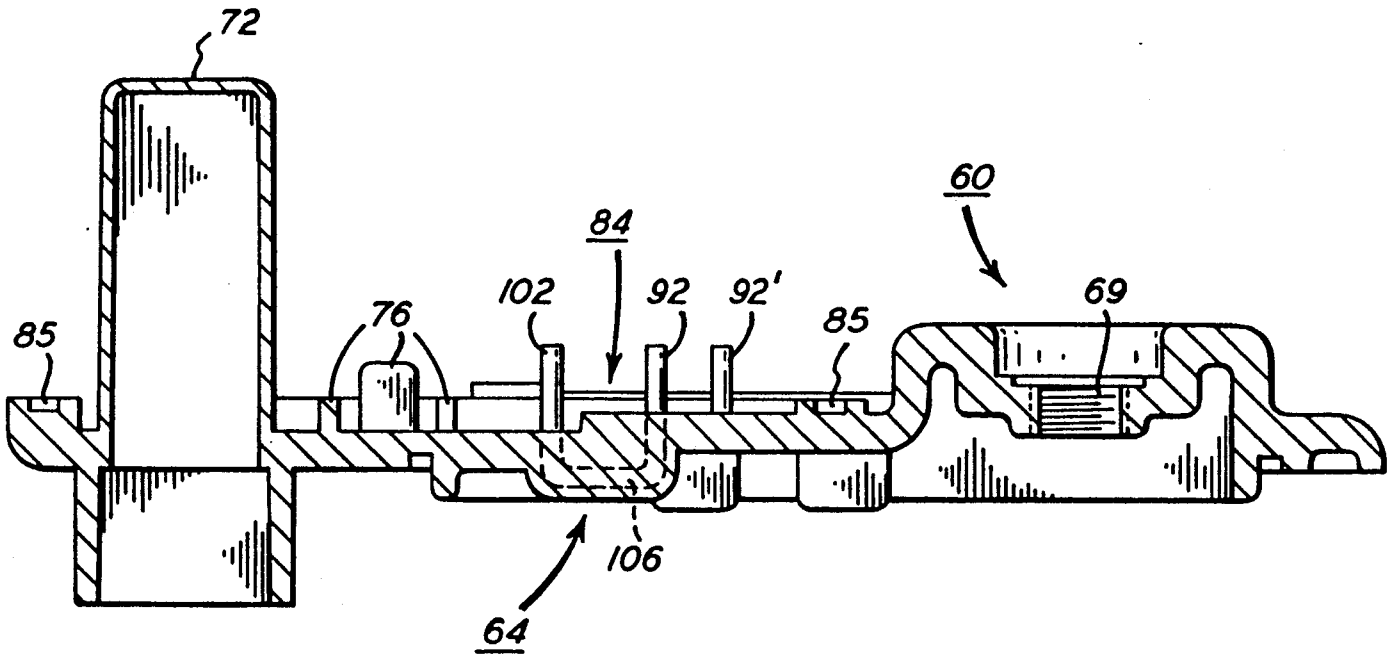
FIG. 4 is side elevational view of the housing cover taken along lines 4—4 of FIG. 3.

As shown in FIGS. 1 and 4, the housing cover 60 includes a motor side 64 and a switch side 84. As shown in FIGS. 1 and 4, the motor side 64 includes a configured groove 65 defining a path which mirrors the sealing surface 32 of the housing 20. The groove 65 is sized to retain a seal 66 therein, such that upon operable connection of the housing cover 60 and the housing 20, a fluid tight seal is formed therebetween, and the motor cavity 21 is substantially sealed from the operating environment. That is, the housing cover 60 forms a partition between the housing 20 and the switch cavity 150.

In the alternative embodiments of the housing 20, such as the multi-component housing or the inverted cup, the motor cavity is a substantially sealed chamber and the sealing interface is adjacent the base. Therefore, either the housing 20 or the housing cover 60 may form a partition between the switch cavity 150 and the motor 26.

Referring to FIGS. 1 and 4, the housing cover 60 includes a fill socket 69 for introducing lubricants into the motor cavity 21. The fill socket 69 is selectively sealed by a threaded plug (not shown) as is well known in the art. Alternatively, the pump may employ an air filled motor cavity wherein the fill socket 69 is eliminated from the housing cover 60.

Referring to FIGS. 3 and 4, the switch side 84 of the housing cover 60 includes a continuous channel 85 for receiving a seal 88. The channel 85 substantially defines the area of the switch cavity 150. The channel 85 and seal 88 define a sealing interface between the switch cover 120 and the housing cover 60. As shown in FIG. 3, the housing cover 60 includes a plurality of fastener sockets 89 adjacent the channel 85.

Referring to FIGS. 1 and 3, two sets of electrically conductive pins extend through the housing cover 60 within the periphery of the channel 85. The first set of electrically conductive pins are power pins 92 which extend through the housing cover 60 to extend into the motor cavity 21. The power pins 92 provide transmission of electrical power to the motor 26. The second set of electrically conductive pins are switch pins 102 which extend through the housing cover 60 into the motor cavity 21. Preferably, the power and switch pins 92, 102 are substantially cylindrical members formed of brass or other electrically conductive material, and are molded into the housing cover 60 by means well known in the art.

As shown in FIG. 4, in a preferred embodiment, three power pins extend through the housing cover 60. The first power pin 92 is the ground line, the second power line pin 92' is the power and the third power pin 92'' is connected to an embedded lead 106. In the preferred embodiment, there are two switch pins 102, wherein the first switch pin extends through the housing cover 60 and the second switch pin is connected to the embedded lead 106. The terminal ends of the embedded lead 106 form one power pin and one switch pin. Other than the connection with the power supply and the switch 50, the remaining length of the embedded lead 106 is encapsulated within the housing cover 60. The encapsulation isolates the electrical connection from the operating environment and the internal environment of the pump.

Referring to FIGS. 1, 3 and 4, the housing cover 60 includes a tower 72 defining a vertically oriented pocket within the periphery of the channel 85. The tower 72 is sized to slideably receive a portion of the float assembly 160. As shown in FIG. 3, the tower 72 has a substantially rectangular cross section. That is, the tower 72 can cooperatively receive the float assembly 160 in only two specific orientations. Alternatively, the tower 72 may have an asymmetrical cross section which permits cooperative alignment of the float assembly 160 in only a single orientation.

As shown in FIGS. 1, 3 and 4, the housing cover 60 also includes integral alignment tabs 76 within the periphery of the channel 85. The alignment tabs 76 are located to position the modular switch mechanism 50 relative to the tower 72 and the switch pins 102. The tabs 76 provide for horizontal alignment of the switch mechanism 50. As the configuration of the modular switch 50 may vary depending upon the specific switch employed, the precise location of the alignment tabs 76 is determined by design considerations.

The housing cover 60 is preferably formed of a molded polymeric material such as flame retardant glass filled polypropylene and is a one piece integral unit.

As shown in FIG. 1, the hermetically sealed switch cavity 150 is formed by engagement of the switch cover 120 and the housing cover 60. The switch cavity 150 forms a hermetically sealed switch capsule. Although the switch cover 120 is shown engaging a portion of the housing cover 60, the switch cover may engage a portion of the housing 20 to form the switch cavity 150. That is, either the housing cover 60 or the housing 20 can form the partition between the motor and the switch mechanism 50, while the switch cover 120 isolates the switch mechanism from the environment. The specific location of the switch cavity 150 is a matter of design choice, as dictated by the anticipated environment of the pump.

Referring to FIGS. 1 and 6, the switch cover 120 is sized to enclose the tower 72 and the switch mechanism 50. Preferably, the switch cover 120 is a molded one piece substantially cup shaped member. Referring to FIG. 5, the switch cover 120 includes peripheral flanges 122 having fastener apertures 123 for retaining fasteners for securing the switch cover 120 to the housing cover 60. As shown in FIGS. 1 and 6, the switch cover 120 has a planar peripheral sealing surface 126 corresponding to the channel 85 on the switch side 84 of the housing cover 60 such that upon operable engagement of the switch cover and the housing cover the seal 88 in the channel is partially compressed and hermetically seals the switch cover relative to the housing cover to form the hermetically sealed switch cavity 150. The switch cover 120 also includes depending ribs 124 for contacting a portion of the switch mechanism 50 to retain the portion of the switch mechanism between the switch cover and the housing cover 60. The depending ribs 124 preclude unintended vertical movement of the switch mechanism 50. Therefore, the depending ribs 124 of the switch cover 120 and the alignment tabs 76 of the housing cover 60 operably align and retain the switch mechanism 50 in both the horizontal and vertical direction, thereby eliminating the need for secondary fasteners to operably locate and retain the switch 50.

Referring to FIGS. 1, 5 and 6, the closed end of the switch cover 120 includes a threaded aperture 133. The aperture 133 is concentric with the power pins 92 and is configured to releasably retain a power cord (not shown) to the switch cover 120. Upon operable engagement of the switch cover 120 with the power supply and the housing cover 60, the switch cavity 150 is sealed from the pump environment as well as the operating environment, wherein no moving components extend through the walls which form the cavity. However, the switch cavity 150 may be formed so as to exclude the power pins 92. That is, the housing cover 60 may include a receptacle adjacent the power pins 92 for releasably securing the power supply, so that the aperture 133 is removed from the switch cover 120. The switch cover 120 may then be formed to enclose only the switch 50 and the switch pins 102.

As shown in FIG. 1, the switch cavity 150 is sized to retain the modular switch assembly 50. The switch assembly 50 is a magnetically actuated mechanical switch which cooperates with the float assembly 160, to control the motor 26 in response to fluid levels outside the pump. Referring to FIG. 7, the present pump design includes barrel contacts 140 for interconnecting the modular switch 50 and the switch pins 102. The barrel contacts 140 are tubular members sized to slideably receive a length of the switch pin 102 extending above the housing cover 60. The barrel contacts 140 permit electrical connection of the switch 50 and switch pins 102, without requiring soldering, crimping or additional harnesses. As previously stated, the alignment tabs 76 of the housing cover 60 and depending ribs 124 of the switch cover 120 engage flanges or surfaces on the modular switch 50 to operably align the switch with respect to the tower 72 and switch pins 102.

As shown in FIG. 1, the float assembly 160 is operably positioned external to the housing 20 and cooperates with the modular switch 50. The float assembly 160 is remote from the outlet 24 to permit service connection to the outlet without requiring displacement of any of the float assembly or risking damage to the float assembly. The float assembly 160 includes a float rod 162 and a float 172. The float rod 162 is an elongated rod with a magnetic carrier 164 at one end. The magnetic carrier 164 has a rectangular cross section sized to be slideably received within the tower 72 of the housing cover 60. The magnetic carrier 164 retains a vertically oriented magnetic element 166 which is vertically displaceable to magnetically actuate the switch 50 in response to a predetermined level of the float 172. While the magnetic element 166 is shown as a disk, the element may be any of a variety of configurations such as conical, cubic or arcuate. The second end of the float rod 162 is substantially cylindrical and is sized to be slideably received in the aperture 37 of integral guide 36. Proximal to the second end of the float rod 162, a pair of tabs 168 extend radially from the float rod. The tabs 168 limit the range of movement of the rod 162 and preclude excessive downward motion of the rod by contacting the guide 36.

The float 172 is a solid member formed of a light weight material having a density less than the fluid to be pumped. The float is formed of a closed cell material such as urethane. Therefore upon chipping, puncturing or degradation of the float 172, the float will continue to function properly. As shown in FIG. 2, the float 172 has a non circular cross section, and is defined by a sufficient radius to generally conform to the adjacent section of the housing 20. The configured float 172 reduces the footprint of the pump assembly and allows use of the pump in previously unattainable places. The float 172 includes a pair of guide bumps 174 for contacting the side of the housing 20 to preclude rotation of the float 172 relative to the float rod 162. The float 172 includes a vertical key way 175 extending through the float. The key way 175 is defined by a substantially circular cross section having opposing recesses 177 extending from the circular portion. The float 172 also includes a balance ridge 178 opposite the bumps 174. The balance ridge 178 evenly distributes the weight of the float 172 about the key way 175 so that the float freely travels along the rod 162.

The key way 175 and the tabs 168 on the float rod 162 permit ready assembly of the float assembly 160 and retention of the float and float rod in a preferred orientation. Specifically, the tabs 168 and the key way 175 are configured such that upon operable connection of the float 172 and the float rod 162, the tabs are not aligned with the key way, and removal of the float 172 from the rod is precluded. To operably connect the float 172 to the float rod 162, the float 172 is rotated from the operable orientation so that the tabs 168 pass through the key way 175. Once the tabs 168 have passed through the float 172, the float is rotated to the operable position so that the float is effectively locked onto the float rod 162.

The lower end of the float rod 162 passes through the aperture 37 in the integral guide 36. Rotation of the float rod 162 is precluded by the alignment of the magnetic carrier 164 and the tower 72. Rotation of the float 172 relative to the float rod 162 is precluded contact of the guide bumps 174 and the housing 20.

In operation, the upper portion of the float 172 contacts the magnetic carrier 164 to urge the magnetic element 166 upward relative to the switch 50, thereby actuating the switch and pump.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A pump assembly having a motor, comprising:

(a) a housing having a motor cavity for receiving the motor;

(b) a housing cover sized to contact the housing to substantially close the motor cavity;

(c) a switch cover for sealingly engaging at least a portion of the housing cover to form a sealed switch cavity between the switch cover and the housing cover, the switch cavity being free of operating linkage extending from inside the switch cavity to outside the switch cavity;

(d) an electrically conductive power pin extending through the housing cover to the motor cavity;

(e) an electrically conductive switch pin extending through the housing cover between the switch cavity and the motor cavity, wherein at least one interconnection between the power pin and the switch pin is substantially embedded within the housing cover;

(f) a float for displacing a magnetic element in response to a predetermined fluid level; and (g) a magnetically actuated switch within the switch cavity for selectively connecting the power pin to the switch pin in response to vertical displacement of the magnetic element.

2. The pump assembly of claim 1 wherein the switch cover includes an aperture for sealingly connecting to a power supply.

3. The pump assembly of claim 1, wherein the float includes an alignment mechanism for retaining the float in a preferred orientation with respect to the switch.

4. The pump assembly of claim 1 further comprising barrel connectors for interconnecting the switch and the switch pin by slidably receiving a portion of the switch pin.

5. The pump assembly of claim 1, wherein the housing cover includes alignment tabs for operably aligning the switch within the switch cavity.

6. The pump assembly of claim 1, wherein the housing is an integral unit including the motor cavity and a pump volute.

7. A pump for pumping fluid from an operating environment, the pump having a motor, comprising:

(a) a housing having a motor cavity for receiving the motor, the motor cavity being substantially sealed from the operating environment;

(b) a switch cover for sealingly engaging a portion of the housing to form a fluidly sealed switch cavity between the switch cover and the housing;

(c) a conductive electrical power pin extending through the housing to the motor cavity;

(d) a conductive electrical switch pin extending through the housing between the switch cavity and the motor cavity;

(e) a float member operably located outside the switch cavity for displacing a first magnetically reactive element for movement in response to a predetermined fluid level; and (f) a magnetically actuated switch within the switch cavity having a second magnetically reactive element for selectively connecting the power pin to the switch pin in response to displacement of the first magnetically reactive element the first magnetically reactive element being outside the switch cavity and the second magnetically reactive element being inside the switch cavity.

8. A pump assembly for pumping fluid from an operating environment, the pump having a motor and a magnetically actuated switch, comprising:

(a) a housing sized to enclose the motor;

(b) a first magnetically reactive element operably connected to the magnetically actuated switch;

(c) a switch cover sealingly engaged to at least a portion of the housing to form a fluidly sealed switch cavity between the switch cover and the housing, the switch cavity sized to enclose the magnetically actuated switch and the first magnetically reactive element;

(d) a conductive electrical switch pin extending from the housing into the switch cavity;

(e) a float member operably located outside the switch cavity; and (f) a second magnetically reactive element operably connected to the float member outside of the switch cavity for displacing the first magnetically reactive element in response to a predetermined fluid level to actuate the switch.

9. A pump assembly for pumping a fluid in response to a predetermined level of fluid, the pump including a motor and a magnetically actuated switch, the switch including a magnetically coacting element, the assembly comprising;

(a) a housing for retaining the motor;

(b) a fluidly sealed switch capsule operably connected to the housing, the switch capsule having an interior and an exterior, wherein the interior is sized to enclose the magnetically actuated switch and locate the magnetically coacting element in the interior of the switch capsule;

(c) an electrical connection extending between the motor and the switch; and (d) a float mechanism including a float and a magnetically coacting element, the float mechanism being entirely located exterior to the switch capsule and operably aligned with the housing and the switch capsule, the float mechanism including its magnetically coacting element for coacting with the magnetically coacting element of the switch in response to a predetermined fluid level in order to actuate the switch.

10. The pump assembly of claim 7, wherein the switch cover includes an aperture for sealingly connecting to a power supply.

11. The pump assembly of claim 8, wherein the switch cover includes an aperture for sealingly connecting to a power supply.

12. The pump assembly of claim 9, wherein the switch capsule includes an aperture for sealingly connecting to a power supply.

* * * * *